United States Patent [19]

Peloggio

[11] 4,128,066

[45] Dec. 5, 1978

[54] APPARATUS FOR SEWING TOGETHER PORTIONS OF KNITTED ARTICLES

[76] Inventor: Alessandro Peloggio, P.za dei Canonici Lateranensi, 12, Bergamo, Italy

[21] Appl. No.: 739,383

[22] Filed: Nov. 5, 1976

[30] Foreign Application Priority Data

Nov. 21, 1975 [IT] Italy ..... 29537 A/75
Sep. 14, 1976 [IT] Italy ..... 27185 A/76

[51] Int. Cl.[2] ..... D05B 7/00
[52] U.S. Cl. ..... 112/27; 112/138
[58] Field of Search ..... 112/27, 25, 26, 121.15, 112/121.29, 63, 138

[56] References Cited

U.S. PATENT DOCUMENTS 77,611 5/1868 Haslam ..... 112/27
608,826 8/1898 Secor ..... 112/27
1,894,885 1/1933 Parkin ..... 112/25

*Primary Examiner*—H. Hampton Hunter
*Attorney, Agent, or Firm*—Guido Modiano; Albert Josif

[57] ABSTRACT

The apparatus comprises a sewing machine and a supporting member near the sewing machine. The supporting member includes a bed carrying a plurality of impaling pins for supporting one of the fabric portions to be sewn together. The pins are axially slidable between a loading position and an unloading position. The supporting member is guided along a path at least at the sewing machine needle aligned with the path whereal-ong the machine is normally causing the components to be sewn to advance. The pins are controlled to be withdrawn from the loading position into the unloading position as they pass at the level of the sewing machine needle.

8 Claims, 9 Drawing Figures

Fig. 1
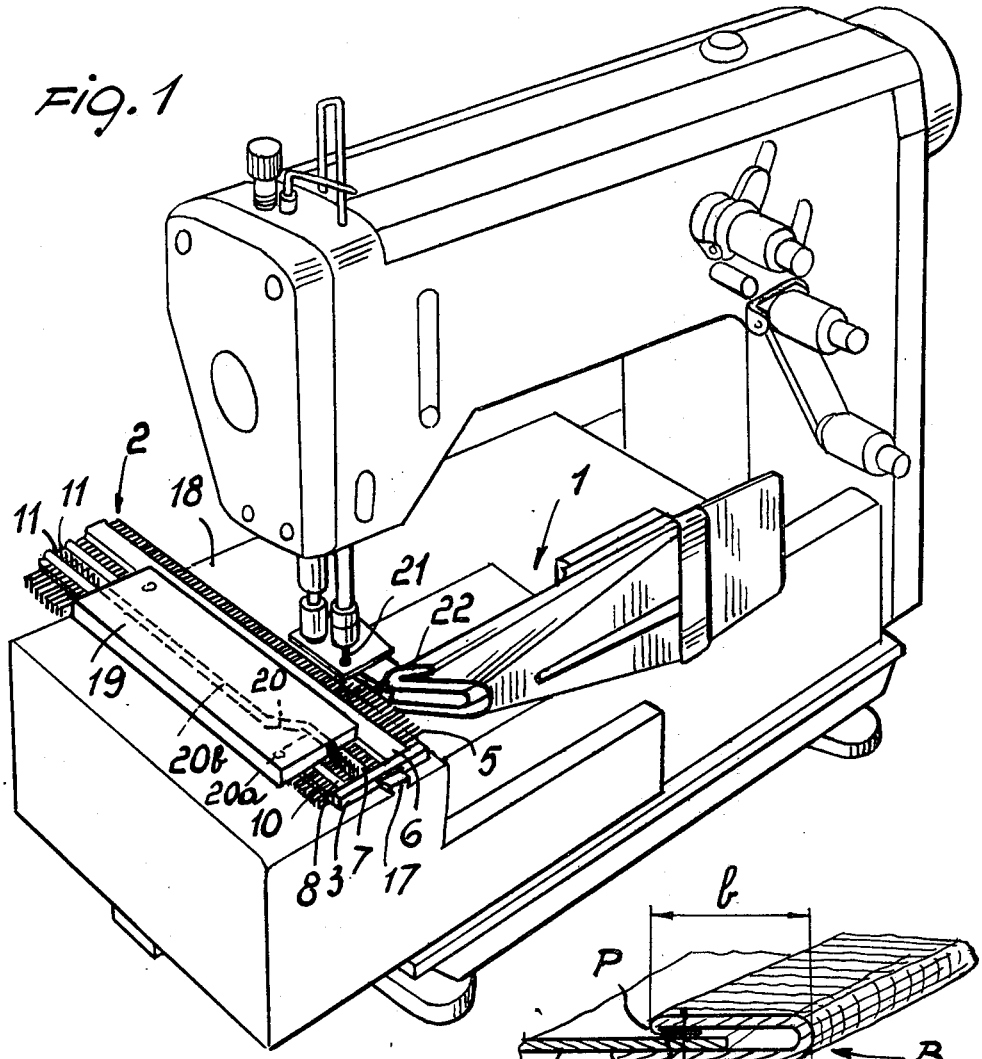
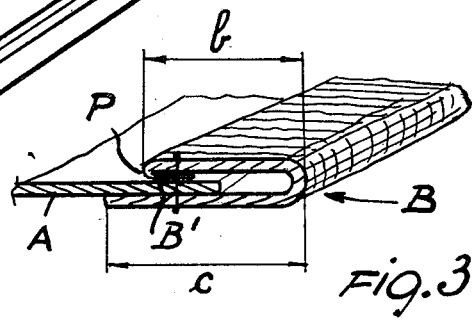
Fig. 3
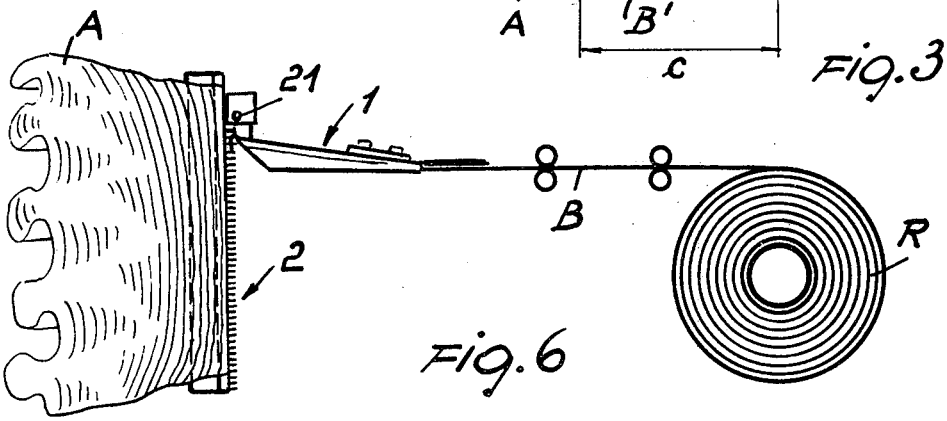
Fig. 6

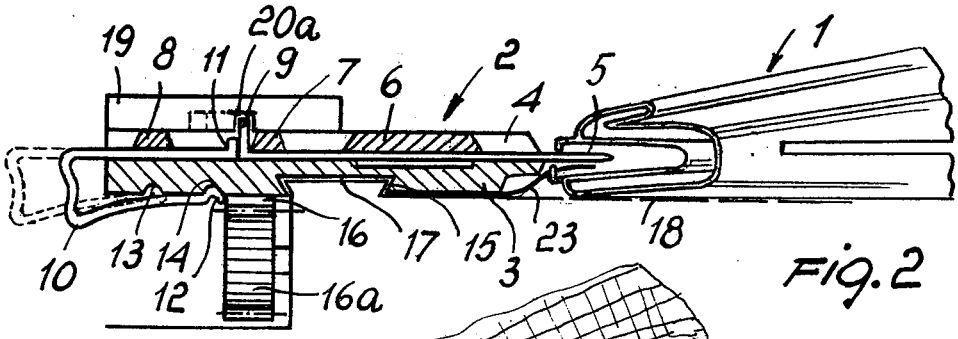
Fig. 2
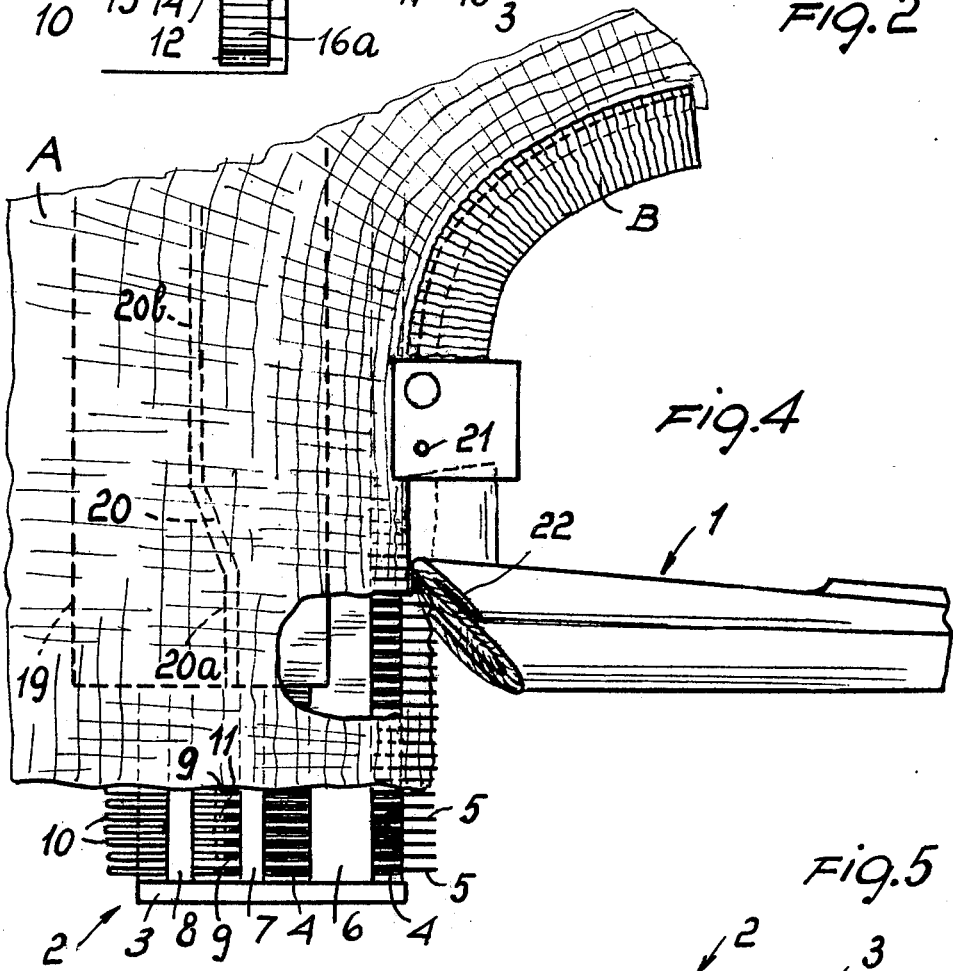
Fig. 4
Fig. 5
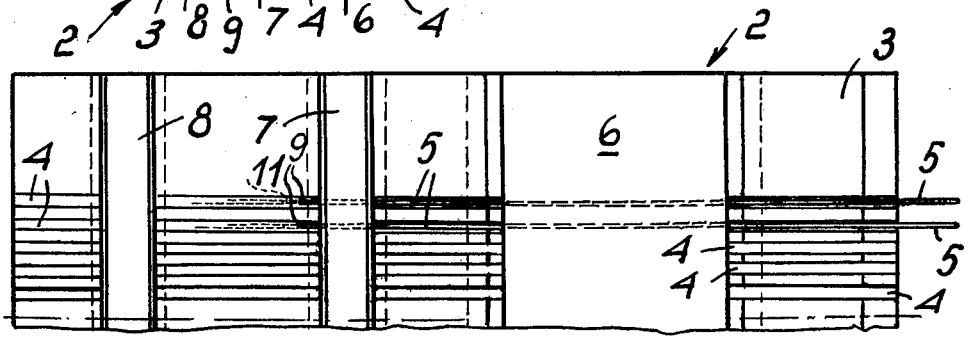

APPARATUS FOR SEWING TOGETHER PORTIONS OF KNITTED ARTICLES

BACKGROUND OF THE INVENTION

This invention relates to an apparatus for accurately sewing together portions of knitted articles on a sewing machine.

The most widely used traditional method of joining together portions of knitted articles of manufacture is known to comprise a so-called "stitch linking" operation, wherein the loops of the edges to be joined in the knitwork are orderly slid, one at a time, over the impaling pins of a linking machine. After this orderly loading of the knitted stitches onto such pins is completed, they are caused to pass by a linking head whereat the stitch linking proper is carried out. The operation provides satisfactory results from an aesthetic and qualitative standpoint, but tends to slow down the whole process, owing additionally to and rather than the speed of the linking needles themselves, to the preliminary and basic operation of applying both articles or pieces to the needles, which operation has generally to be carried out by experienced and skilled personnel. All this brings about the inevitable consequence that where low cost products are aimed at, such a processing method ceases to be economically convenient.

Consequently, for low-cost articles, it has become common practice in the making up of knitwork (i.e., the application of borders for collars, strips, pockets, and other items of finish) to use conventional sewing machines. It will be understood that such machines allow for much higher production rates, with a lesser labor unit cost. On the other hand, this approach results in a far less accurate work, inferior both in quality and appearance; furthermore, the product is subjected to running of the loops since it is evident that the entirely random mode of sewing up the two knitted fabric edges, as performed by the sewing machine needle, leaves out several loops in the end courses of the joined pieces which constitute as many potential sources of running failure or ladders.

As regards the poorer quality of the articles obtained by processing them on a sewing machine, the following should be pointed out. Contrary to the linking machine, where it is provided for the linking to strictly occur at and along the selected course (or, more generally, the row of knitting) as a result of the item of manufacture being preset on the pins in the precise desired arrangement, on the sewing machine the parts to be joined are caused to move forward or advance by specially provided mechanical members of the machine (jaws, wheels, plates, and the like) in a manner that substantially deprives the operator of the possibility to direct the product as it passes under the sewing needle with an absolute and constant degree of accuracy. Now, whereas this inaccuracy may be of less importance in the case of some garments, there exist situations where a not so accurately controlled advance path, i.e., a zigzagging one to some extent (even though only between one course and an adjacent one) results in products of unacceptably poor quality. The instance may be quoted here of two patterned or rib stitch worked pieces that are to be sewn together, wherein perfect alignment and matching of the patterns in the two confronted pieces must be achieved.

Another limitation in the application of sewing machines for joining knitted items of manufacture resides (still by way of example) in the impossibility of joining to a flat stretched edge of one piece another piece which it is desired to keep slightly curled up at the very joining area: it will indeed appear that the operator has no means of controlling that the knitwork is kept curled in the amount and disposition as necessary to achieve the desired effect in the finished garment.

To sum it up, it may be stated that all the limitations cited and others yet, which are well known to the experts in the art, derive from the fact that, at the work area of the sewing machine needle, the item of manufacture is almost entirely, during the advance thereof, "dominated" by the driving mechanical action, thereby the only way in which the operator may control with sufficient (but incomplete) accuracy the stitch line of application would be that of making the work progress very slowly, in order to gain better control over the fabric movement. Such a remedy, however, opposes the basic reason why knitted garments are worked on sewing machines, that is the achievement of faster production rates, or faster sewing and advancing, as such a machine is capable of providing.

SUMMARY OF THE INVENTION

It is a primary object of this invention to obviate the drawbacks mentioned above by providing a method which, while allowing for the knitted articles or items to be sewed up on a sewing machine, concurrently ensures the same degree of accuracy which is rather typical of the works executed with stitch linking machines.

It is another object of the invention to provide an apparatus whereby such a method may be implemented, and by virtue whereof degrees of accuracy and perfection of the resulting work may be achieved on a sewing machine which are comparable to those featured by a linking machine.

It is a further object of this invention to relieve the process of any need to pay constant attention thereto, as well as to reduce the machine operator's fatigue.

It is yet another object of the invention to make provision for the achievement of output rates comparable to those normally expected in the normal sewing process on a sewing machine, the machine own output being, however, kept lower than usual by virtue of a distinct increase in the working rate smoothness.

These and other objects, such as will be apparent hereinafter, are achieved by a method for accurately sewing together portions of knitted fabric on a sewing machine, characterized in that it comprises: pre-arranging on at least one supporting member at least one of said portions orderly applied onto said supporting member so that a zone thereof follows the path wherealong the sewing is to take place, according to the desired distribution and final setting; positioning said supporting member bearing the knitted fabric portion thus prearranged on the machine; advancing said supporting member on the machine along a guided path adapted to positively bring the thus conditioned zone of said knitted fabric portion to interfere with the sewing machine needle after the coupling thereof with an other portion of knitted fabric to be sewn therewith.

The apparatus for carrying out the above method is characterized in that it comprises at least one supporting member including a bed or section carrying a plurality of needles or pins which are axially slidable between a loading position whereat they project outwardly and an unloading position whereat they are withdrawn for the orderly application at said loading position of the loops of the first knitted fabric portion arranged along the path of the sew line with the second knitted fabric portion to be sewn, a guide on the machine adapted to guide said member along a path aligned at least at the sewing machine needle with the path wherealong the machine is normally causing the portions to be sewn to advance, means for controlling said pins between said loading and unloading positions, effective to cause the withdrawal thereof by an axial sliding movement as they pass at the level of the sewing machine needle.

BRIEF DESCRIPTION OF THE DRAWINGS

Further features of the method and apparatus, as well as attendant advantages thereof, will become more apparent from the following detailed description of one of several possible embodiments of said apparatus, illustrated by way of example and not of limitation in the accompanying drawings, where:

FIG. 1 is a perspective general view of the inventive apparatus for an accurate sewing operation;

FIG. 2 shows, in elevation from the inlet end onwards, a detail of the basic components whereby the sewing machine is enabled to execute the sewing along the exact desired line;

FIG. 3 is a detail view of knitted articles of manufacture at the sewing area, for instance, at the area of a folded border applied to the outer knitted body;

FIG. 4 is a plan view of the components shown in FIG. 2;

FIG. 5 is a plan detail view of a portion of the sliding pin bed supporting the knitwork;

FIG. 6 is a general schematic view illustrating the operation of the inventive apparatus;

DESCRIPTION OF THE PREFERRED EMBODIMENTS

Figure 8:
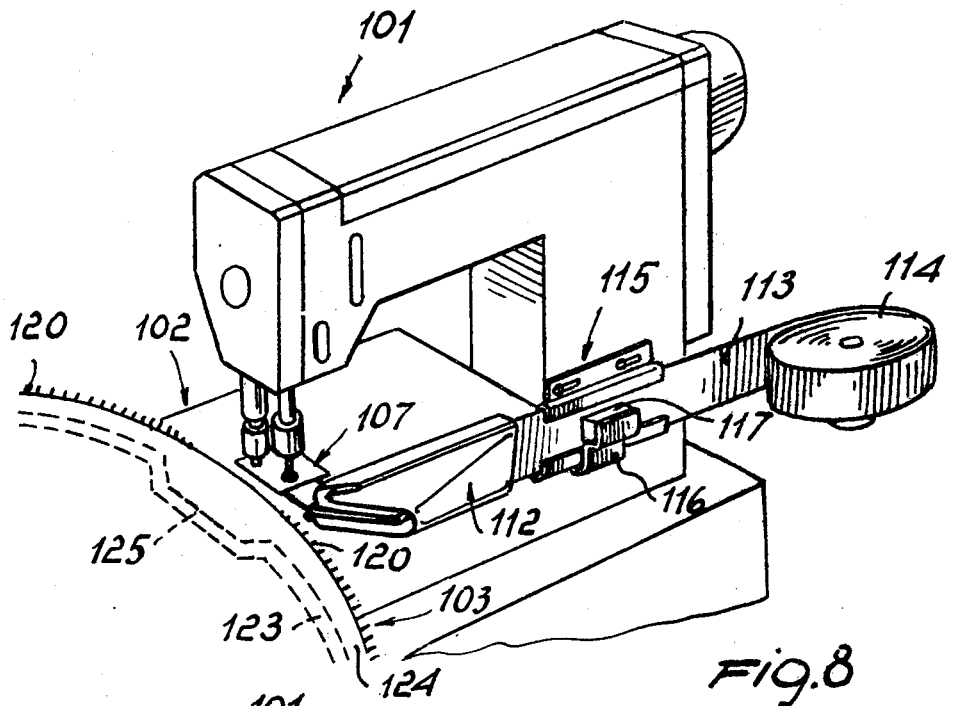
FIG. 8 is a perspective view of the sewing machine evidencing of FIG. 7 the apparatus sewing station.

The ensueing detailed description has been referred to a particular work consisting of applying a folded border as obtained from a knitted strip (constituting the second portion to be sewn) to the edge of a piece or body of knitwork (constituting the first portion to be sewn). This reflects the typical situation encountered, for example, when a border is to be attached to the neck opening of a pullover. However, it will be understood that what is discussed with regards to this example also applies, with due and obvious modifications, to any process whereby two knitted items or portions are to be joined by sewing. FIG. 3 illustrates clearly the type of application considered: to the edge of a knitted fabric A an open tubular element, denoted with B, constituting the second portion or item, is to be attached: the element B is obtained from a flat knitted strip, advantageously including an edge band B' of reduced thickness, adapted to be folded over as shown in the cited FIG. 3, such as not to result in an effect of enhanced thickness. It should be noted here that the manner of folding a flat knitted strip in the fashion of FIG. 3 is known in the art: this is obtained by means of a specially profiled guide, denoted generally with the numeral 1, currently known and applied to sewing machines. It may thus be stated that, in relation to FIG. 1, it is conventional for a sewing machine to incorporate such a guide 1, at the outlet end whereof a strip to be attached is arranged as shown in FIG. 3, and then brought under the sewing needle whereat it is joined with the fabric A.

The substantial problem solved by the inventive apparatus as well as by the method mentioned hereinabove, is to be encountered as the edge of the fabric A is being attached to the strip B, said edge being suitably inserted between the legs of the border as shown in FIG. 3. Now, in order to carry into effect such an operation, the fabric A has first to be carefully introduced within the legs of the border B. In actual practice, however, upon completion of this first coupling step, the operator — who for productivity reasons tends to drive the machine at high operational speed — can only coarsely guide the fabric A along its direction of advance, and is unable to achieve a sew line of controlled precision. It is thus at this stage that the inventive method and apparatus come specially useful.

The apparatus comprises essentially at least one supporting member for the fabric A. Such a supporting member, denoted generally with the numeral 2, includes a bed or plate-like block 3, wherein a plurality of parallel grooves 4 are formed, a needle or impaling pin 5 being inserted for axial sliding movement in each groove 4. More specifically, the plate-like element 3 and related parallel slots 4 are open at the top, and the sliding guide for the pins 5 is defined by superimposing and attaching: a first band or gib 6, a first forward end of travel detent band 7 and a second rear end of travel detent band 8. The bands 7 and 8, in other words, are such as to interfere with a rear butt 9 of each pin 5, such that when the butt a bears against the band 7, the pin is in its loop loading position, thereby it projects frontally from the element 3; by contrast, the band 8 limits the rearward movement or stroke of the pin 5, until the latter is fully withdrawn within its respective sliding movement guide. With each pin 5, a flexible reed 10 of U-like shape, slidably mounted in its respective groove 4, cooperates a heel 11 whereof is in constant engagement with the butt 9 of the corresponding pin, while at 12 it is so shaped as to lock itself alternatively in either of two recesses 13 and 14 formed in the lower face of the bed 3. The recess 14 corresponds to the locking position of the pin 4 in its forward position, whereas the recess 13 corresponds to the locking position of that same pin in its rearward position (see the two positions shown respectively in full lines and dotted).

In its lower face, the bed 3 is provided with a lengthwise guide seat 15 of dovetail configuration, as well as with a rack, extending parallel to said guide seat, shown schematically at 16. The guide 15 is adapted to couple, as the assembly 2 is "loaded" on the sewing machine, with a guide 17 of mating shape provided in the table 18 of the machine. Concurrently therewith, as the assembly 2 is inserted over the machine by means of the coupling 15–17, the rack 16 meshes with a gear wheel 16*a*, kinematically connected to the sewing machine main drive, thus moving the supporting member 2 in a plane substantially perpendicular to the needle of the sewing machine. The kinematic drive ratios (not shown as noncritical and within the know-how of any expert in the art) are such that the linear velocity of advance transmitted to the member 2 along the guide 17 is equal to the rate of advance of the items of manufacture to be sewn imparted by the sewing machine advancing members (wheels, teeth, jaws, pressure shoe, etc.).

As mentioned hereinabove, the guide 1 mounted to the machine, and known per se, is fed with a long and narrow knitted strip, and the guide 1, by virtue of its special shape and configuration, which, as shown in the drawings, has an end leg of lesser thickness than the thickness of the remaining section of the guide element, causes the strip to exit the machine already folded as shown in FIG. 3, and directed to the machine needle, i.e., in the sew line direction of progress. It will be obvious then, without any further explanations, that the various elements so far described are so dimensioned that the pins 5, when moved forward (see FIG. 2) become inserted between the legs or wings of the folded border B, thus bringing the edge of the main fabric to the position shown in FIG. 3. A shaped reed 23 ensures such a correct insertion by holding flat the end edge of the fabric suspended from the pins.

The member 2, in its forward movement along the guide 17, travels below a case member 19 which encloses, for at least a section thereof, the guide 17. Said case defines, on its side facing the pins 5, means for controlling axial movement of the impaling pins. These means comprise a cam track, shown only schematically for clarity sake in phantom lines at 20 in FIG. 1. The stationary cam is profiled such that, with a first section 20*a*, it engages the butts 9 of the pins against the detent 7. However, at the area of the needle 21 of the sewing machine, the profile 20 has a point of inflection and drops to a recessed level 20*b*. The butts 9 of the pins retract accordingly against the bias of the springs 10 (the ends 12 whereof jump out of their seats 14), to stop in their rearmost positions (locking of the ends 12 in the seats 13). In this manner, the pins 5 are held extended for a first portion of the assembly 2 movement, and slide while kept inserted within the flap B, i.e., they follow a path which would cause them to interfere with the sewing machine needle owing to the fact that they extend substantially perpendicularly to the needle. However, just before reaching the needle, they are caused to withdraw, thereby such an interfering is effectively prevented.

Having thus described the structure of the apparatus, the operation thereof will be next described.

The supporting member 2 is initially dissociated from the machine. It may, for instance, be mounted on a bench, where it would appear similar to a linking machine comb, with all the pins 5 extended. In this condition, it is extremely easy for an operator to apply in an orderly fashion the item of manufacture over the pins following the path imposed by the garment design requirements. As is known, such an operation of simply inserting the item of manufacture following the desired contour (any one) may be carried out by a skilled person very quickly and easily. This application allows, therefore, for the presetting, in a strictly correct manner, and alignment of the fabric A edge which is to be then coupled with the border B and sewn thereto. This "presetting" may be taken to such extremes as to pack together loops at some areas and disperse them at others, and make the alignment to follow strictly, for example, a pattern or row in the fabric A. All these steps, as is known, are essential to a perfect alignment — depending on the pre-disposed pattern — of one component of a knitted garment with another component thereof.

Once this preliminary and basic application has been carried out, the assembly 2 carrying the fabric A suspended, is inserted into the guide 17 of the deck 18, and pushed to cause the rack 16 to engage with the drive members 16*a*. From this moment, the advancing of the assembly 2 becomes automatic. Owing to the synchronization of the member 2 advance with the drag action exerted on the border B directly by the machine components, the border B and fabric A move forward in perfectly timed relationship: moreover, the fabric A, which moves along with the member 2, suffers no heeling or transverse shift, thereby it appears under the needle in the precise position and direction as desired, so that the sewing may take place with absolute accuracy. In fact, the item of manufacture carried by the pins is progressively released by these latter — under the influence by the cam 20 — immediately before it passes under the needle of the sewing machine.

The above brings about the further advantage that, upon starting the work cycle, since the operator is no longer compelled to "guide" manually the fabric A, the sewing may be carried out at practically uniform velocity, a sufficiently high one, but without raising the machine own speed of operation to those excessively high levels which serve to compensate for the slowing down which, in the traditional machines, is due to the irregular progressing of the work by the operator's own hand.

The work may then progress on the sewing machine in a practically automatic manner and the operator's task is reduced to starting the successive beds 2 on the guide 17 magazine-like.

In order for the work to be carried out — as regards the machine operation — in a fully automatic mode, by means of the machine drive motor only (which transmits motion both to the sewing machine components and to the comb 2 through the rack 16), the machine is provided with a first feeler or sensor which starts the drive motor as the insertion of a loaded comb or bed carrying the fabric or body to be sewn is detected thereby. Thus, once the machine has been started, the latter performs concurrently the forward movement of the comb, along with the border B, and the sewing. The operation goes on until a second feeler "feels," at the outlet end, the passing of the comb "tail," which indicates that the work on the comb loaded piece has been completed. This second feeler is thus effective to automatically stop the machine. However, the machine will start again, as soon as a fresh comb is started along the guide 17 to act upon the first feeler. It will be clearly apparent now that the machine operates in a fully automatic mode, by starting and stopping depending on whether the garment to be sewn is present or not, and the operator only has to load the subsequent combs on the guide 17.

The machine automation may, however, be pushed still farther. It is known, that the boarders, as folded like in FIG. 3, in order to result in a product of satisfactory quality, are obtained by means of straight bar knitting machines: this means that the strips wherefrom the borders are obtained have a limited length, corresponding to the maximum width of the machine that produces them. Now, in order to avoid the use of short lengths of such strips, which have to be successively inserted (with attendant inconvenience) one after the other into the guide 1, it has become common practice to prepare long rolls R, prepared from such strips sewn together one after the other. However, as is apparent, at the transition areas, i.e., where the tail end of one strip is sewn to the leading end of the next strip, that section of continuous web cannot be used for the formation of the borders since it is made unacceptable by the evidence and thickening of the sewn seam. On the other hand, since it is impossible to ensure that the distance between two successive seams or sewn joints in the web corresponds to an exact multiple of the length of the collars to be applied to the body or fabric A, it is clear that a portion of the web has to be discarded from astride the seam area.

The machine according to the invention allows this result to be achieved in an automatic manner, by simply pre-arranging, along the path of the web (FIG. 6) and before the latter starts along the guide 1, a thickness feeler for the web. This feeler or sensor is adapted to detect the passing by of the discontinuity area (identifiable by a greater thickness dimension due to the sewed seam of the two web ends). This feeler is connected, through an electric circuit not shown because within the know-how of any expert in the art, to a disengage clutch in the kinematic connection between the driving members and the means for advancing the comb 2. Accordingly, this latter feeler — which is adjustably positionable such as to detect in advance when the seam in the web would fall within a border length — by detecting the passing by of this thickened portion of the web, momentarily inhibits the driving of a fresh comb 2, while it allows the progressing of the sewing on the machine. Thus, the latter executes the sewing "idly," i.e., only applies it to that border section (already folded over on exiting the guide 1) which includes the seam. A second feeler, at the outlet end; in response to the passing by of this seam, cancels out the preceding inhibition and resets the kinematic connection with the drive members of the combs 2. Consequently to this, the machine operation is non-stop, and the machine may be loaded with a web R (for the subsequent folding over and border formation thereof) having a practically infinite length.

It will be noted, from FIG. 3, that the dimension b is slightly less than the dimension c. This artifice is made necessary by the requirement of pushing further the "stitch linking" effect of the work, although a normal sewing machine has been used to this aim. In fact, considering that an upper flap (see FIG. 3) is to be found on the outside of the item of manufacture, upon completion of the border application, and considering the circumstance that the flap B' is of a finer material (the web may be, for example, of wool and the flap B' of a relative elastic yarn), it will be understood that the fold in the cited flap B' may be obtained with extreme accuracy, almost as a sharp corner. This permits (by means of a normal adjustment in the axial direction to the guide 1) the sewed line practically level with the tip P, and this sewed seam, thanks to the constant orientation of the folded border, permits in turn to execute the sewing strictly level, in an automatic manner and for the whole cycle time.

Naturally, and consequently, the width of the folded leg 22 of the guide 1 (wherealong the thinned edge B' of the border web is to run) is also thinner than the remaining portion of the guide, and this contrary to the practice adopted hitherto.

Figure 7:
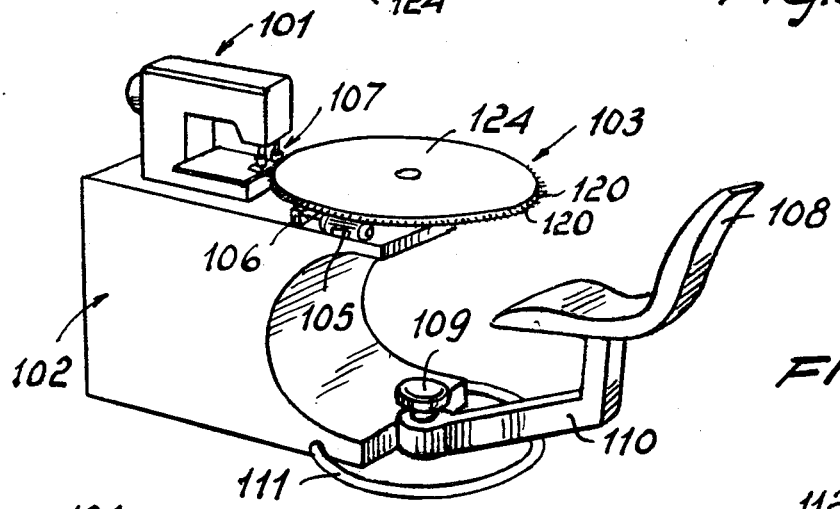
FIG. 7 is a general perspective view of another embodiment of the apparatus according to the invention.

According to a variation of this embodiment, similar in concept to the one described hereinabove, and shown in FIGS. 7, 8, and 9, the inventive apparatus comprises a sewing machine 101, known per se, mounted to a base 102 whereto a supporting member is also mounted, as shown generally at 103, for the knitwork. Said supporting member 103 is pivotable about its axis and is engaged with the base 102; moreover, said supporting member, having a circular shape, has at least one section of its periphery disposed at the sewing machine 101 needle. In fact, as shown in FIG. 7, the radius of the supporting member substantially corresponds to the distance between the center of the supporting member and the axis of the needle of the sewing machine.

The circular supporting member 103 rotates continuously under the drive by a motor 105 at a speed which it is possible to control through a variator 106.

Said supporting member 103 is advantageously formed as a large radius circular crown and has a section of its periphery in engagement at the sewing area 107 of the sewing machine 101. To the base 102, a seat 108 is also connected which is pivotable about a pivot pin 109 whereto it is connected through an arm 110. The pivot pin 109 rotation axis substantially coincides with the axis of the circular supporting member 103 rotating about the axis 104.

A guide 111 is also connected to the base 102 to act as a footrest for the operator.

The circular knitwork supporting member 103 comprises substantially a base block 118 of circular crown configuration, whereon a plurality of radial grooves 119 are formed, a needle or impaling pin 120 being arranged for insertion and sliding movement in an axial direction in each of said grooves, as well as in a radial direction with respect to the supporting member.

With each needle or pin 120, there is associated a reed or blade 121 also slidably mounted in the radial groove 119. Both the needle 120 and reed 121 are provided with a shoe, respectively **122*a* and 122*b*, adapted for engagement in a stationary cam track 123 formed in a covering element 124 of the base block 118**.

Figure 9:
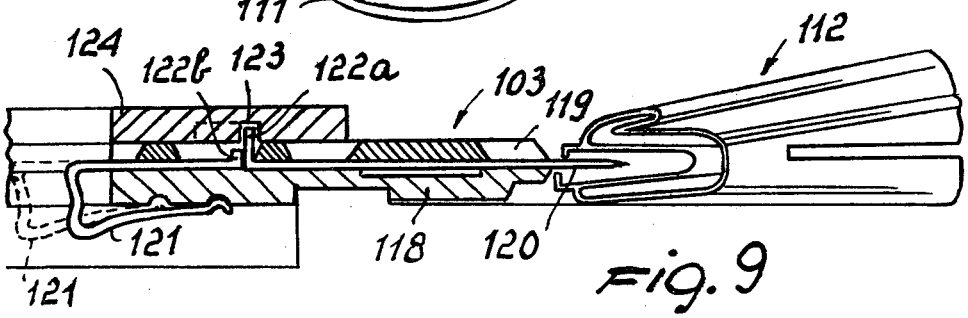
FIG. 9 is a sectional view of the basic components of the apparatus of FIG. 7 whereby the sewing machine is enabled to execute a precision sewing up of the items.

Said cam track 123 has an annular profile pattern schematically indicated in dotted lines in FIG. 8. As deducible from this Figure the profile of the cam includes a portion 125 proximate to the needle of the sewing machine which has a radius smaller than that of the remaining portion of the cam track 123. The track 123 provides for the extension and withdrawal of the pins 120, between a loading position and an unloading one, the loading position being here the position whereat the pins are extended on the circular supporting member 103, whereas the unloading position is the position whereat the pins are withdrawn and arranged at the sewing area, denoted with the numeral 107.

The apparatus according to the invention operates as follows. The circular supporting member 103 is always associated with the sewing machine 101 at the sewing area 107, and rotates with a uniform motion the velocity whereof rather than being related to the fixed one of the sewing machine itself is independent thereof and adjustable through the variator 106.

The needles or pins 120 are projecting all around the circumference of the circular supporting member 103, excepting for a small portion constituted by the cited section at the sewing area 107.

Given this condition, it becomes easy for an operator to apply the knitwork onto the pins 120, following along the desired sew line, not dissimilar from what is done on a conventional linking machine. The operator, accomodated on the seat provided, is enabled to move around by pushing with his feet and against the guide 111, thereby he turns around the guide 103 in order to apply the knitted body thereto.

The operation is as a whole an easy and quick one for an adequately skilled operator, who thus enjoys the utmost freedom in the mounting of the knitwork onto the broad loading area provided by the circular supporting member 103.

Upon insertion on the pin of the circular supporting member 103, the knitwork is brought, by rotation as mentioned of the member 103, to the sewing area, whereat it is presented under the needle in the precise position and direction desired.

Considering now a particular condition wherein a knitted strip, denoted with 113 in the accompanying drawings, is to be applied to the knitwork, the machine also comprises a shaped guide 112, known per se, such that the strip 113 is caused to fold and take a suitable shape under the sewing needle. The knitted strip 113 is stored in a spool 114 wherefrom it unrolls, and before it reaches the shaped guide 112 is passed along a second guide 115, whereto a slide 116 is coupled slidably which carries a sensor 117 responsive to the passing of the seam of the knitted strip 113 into the second guide 115.

The sensor 117 is enabled to act through an electronic control unit, known per se, on the sewing machine operation, such as to prevent the strip 113 seam areas from being applied to any of the knitwork pieces.

The invention herein described fully achieves the objects set forth above.

As repeatedly mentioned during the description hereinabove, a work rate is obtained which is quite comparable with the rates obtainable with conventional sewing machines, but with a quality output decidedly superior, and a final result quite in keeping with the quality level of the linking process (a slower one, however) as used heretofore.

In particular, the presetting of the knitted body on the comb members 2 permits the obtainment of any desired effects, which may be further favored by affixing a reference scale to the comb member in order to simplify and facilitate the application of the knitted row onto the comb needles.

It should be pointed out that the solutions illustrated are intended as mere guidelines, and that numerous modifications and variations may be devised by the expert without departing from the true scope of the invention, as hereinabove described and hereinafter claimed.

I claim:

1. An apparatus for sewing together portions of knitted fabric, comprising a sewing machine having a needle and means for advancing one of said knitted fabric portions to be sewn, at least one supporting member including a bed, means for moving said supporting member in a plane substantially perpendicular to said needle and said bed along a path aligned at least in proximity of said needle with the path wherealong said advancing means cause said one of said knitted fabric portions to advance, a plurality of impaling pins axially slidable within said bed in a direction substantially perpendicular to said needle between an unloading position whereat they are withdrawn within said bed and a loading position whereat they project outwardly of said bed for the orderly application thereon of the loops of the other of said knitted fabric portions along the path of the line to be sewn with said one of said knitted fabric portions, and means for controlling said impaling pins between said loading and unloading positions, effective to cause the withdrawal of said impaling pins within said bed as they pass in proximity of said needle.

2. An apparatus according to claim 1, wherein said means for moving said bed comprise means for advancing said bed in timed relationship with said advancing means of said sewing machine.

3. An apparatus according to claim 1, wherein said means for controlling said impaling pins comprise butts on said impaling pins and a stationary cam adjacent said bed for slideably engaging said butts, said cam defining a passage for said butts configurated to withdraw said impaling pins as they pass near said needle.

4. An apparatus according to claim 1, further comprising a guide element to form a folded border on said one of said knitted fabric portions and advancing said folded border to said needle along a path coincident, at least at a final section thereof, with the path of said other of said knitted fabric portions in the proximity of said needle.

5. An apparatus according to claim 4, wherein said guide element is shaped for receiving a knitted strip and folding said knitted strip into an open tubular configuration, said guide element having an end leg of lesser thickness than the thickness of the remaining section of said guide element.

6. An apparatus according to claim 1, wherein said supporting member has a circular configuration and is rotatable about its own axis, the radius of said supporting member substantially corresponding to the distance between the center of said supporting member and the axis of the needle of the sewing machine, said pins being arranged radially with respect to said supporting member.

7. An apparatus according to claim 6, further comprising a drive motor for rotating said circular supporting member with a speed which is adjustable independentely of the sewing machine own speed.

8. An apparatus according to claim 6, comprising a stationary circular element covering said circular supporting member and having a groove therein for slideably engaging butts of said pins, said groove having an annular configuration including a portion proximate to the needle of the sewing machine which has a radius smaller than that of the remaining portion of said groove.

* * * * *